US009027179B2

(12) United States Patent
Curtis

(10) Patent No.: US 9,027,179 B2
(45) Date of Patent: May 12, 2015

(54) PORTABLE PLAYPEN

(76) Inventor: Catherine Dolores Curtis, Jersey (GB)

( * ) Notice: Subject to any disclaimer, the term of this patent is extended or adjusted under 35 U.S.C. 154(b) by 36 days.

(21) Appl. No.: 13/130,178

(22) PCT Filed: Nov. 19, 2009

(86) PCT No.: PCT/GB2009/002704
§ 371 (c)(1),
(2), (4) Date: Jul. 5, 2011

(87) PCT Pub. No.: WO2010/058170
PCT Pub. Date: May 27, 2010

(65) Prior Publication Data

US 2011/0260130 A1 Oct. 27, 2011

(30) Foreign Application Priority Data

Nov. 21, 2008 (GB) ..... 0821392.8

(51) Int. Cl.
*A47D 13/06* (2006.01)

(52) U.S. Cl.
CPC ..... *A47D 13/063* (2013.01)

(58) Field of Classification Search
USPC ..... 5/98.1, 99.1; 135/135, 98
See application file for complete search history.

(56) References Cited

U.S. PATENT DOCUMENTS

| | | | | |
|---|---|---|---|---|
| 2,498,203 | A | 2/1950 | Fischer | |
| 6,357,462 | B1 | 3/2002 | Laosunthara et al. | |
| 8,056,572 | B2 * | 11/2011 | Livacich et al. | 135/98 |
| 2004/0226596 | A1 | 11/2004 | Chai | |
| 2005/0081903 | A1 * | 4/2005 | Wang | 135/126 |
| 2008/0034498 | A1 | 2/2008 | Chen et al. | |
| 2008/0115268 | A1 | 5/2008 | McCluskey et al. | |
| 2008/0189854 | A1 | 8/2008 | Thorne et al. | |

FOREIGN PATENT DOCUMENTS

| | | | |
|---|---|---|---|
| BE | 690 135 | 5/1967 | |
| DE | 20 2007 004 445 | 8/2007 | |
| EP | 1 741 366 | 1/2007 | |
| FR | 1 506 461 | 12/1967 | |
| FR | 2842401 A1 * | 1/2004 | |
| GB | 2 299 268 | 10/1996 | |
| GB | 2 355 472 | 4/2001 | |
| GB | 2355472 A * | 4/2001 | E04H 15/40 |

OTHER PUBLICATIONS

British Examination Report of British Application No. 0821392.8 dated Jul. 30, 2010 (English Text).
Written Opinion of International Application No. PCT/GB2009/002704 filed Nov. 19, 2009 and dated Mar. 15, 2010 (English Text).
International Search Report of International Application No. PCT/GB2009/002704 filed Nov. 19, 2009 and dated Mar. 15, 2010 (English Text).
International Search Report of International Application No. PCT/GB2009/002704, dated Mar. 15, 2010 (English Text).
British Search Report of British Application No. GB0821392.8 dated Jan. 26, 2009 (English Text).

* cited by examiner

*Primary Examiner* — Peter M Cuomo
*Assistant Examiner* — Brittany Wilson
(74) *Attorney, Agent, or Firm* — Fay Sharpe LLP

(57) ABSTRACT

A portable playpen which can be erected, collapsed and carried while holding a baby, includes a framework supporting an enclosure for a child. The framework has a generally pyramidal structure when it is erected.

10 Claims, 11 Drawing Sheets

PORTABLE PLAYPEN

BACKGROUND

This invention relates to a device for safe containment of a baby, commonly known as a playpen, and in particular to a playpen which can be erected/collapsed while holding a baby, and carried while holding a baby. It will of course be understood that although the intention is for the product to be used for babies, a playpen according to the invention could equally be used for containing pets or the like.

Carers of babies often have to carry out other tasks at the same time as looking after a baby, often moving from room to room, necessitating a safe space to place the baby. Accordingly various devices for curtailing a baby/toddler's movement have been proposed. For example, pushchairs, bouncy chairs, babywearing slings, car-seats, prams, baby bouncers, baby swings, high chairs, carry-cots, gates attachable to doorways, cots, and in particular playpens are all available and have been used for this purpose. However, there are various features which an ideal device should include, in particular: mobility from room to room and up stairs; freedom for a baby to sleep, sit and stand; and a simple mechanism for erecting and collapsing while holding a baby.

A playpen is the ideal candidate for providing a safe place for a baby to sit, sleep and stand, that can be moved between rooms and up and down stairs. However, known playpens are difficult to put up/take down while holding a baby. A typical example of a known playpen intended address this issue is disclosed in US Patent No. 2008/0189854. The foldable playpen discussed in US'854 is shown in more than one embodiment, one of which is put up by hand, by pushing down on a handle which causes the structure to take up a shape similar to an open topped box, with four sides which support a fabric container. The playpen can be collapsed by reaching into the middle of the bottom of the box-like structure and lifting the handle; this pulls a series of cables which extend through the frame and unclip slide bolts to fold the playpen back up.

The second embodiment includes a motorized system for activating the cables to put up/take down the playpen.

However, even this design suffers certain disadvantages. It does not appear to be possible to open, close and carry while holding a baby and with the motor to fold it, etc, it will still be bulky to carry about and therefore unsafe to carry upstairs while holding a baby. As for the closing/opening mechanism, due to the number of parts it will be liable to break, heavy and hard to use without a motor. With a motor, there are more dangerous small parts and it will be even heavier. Moreover it is complicated and therefore expensive to manufacture. Furthermore, due to the position of the handle (low down and surrounded by the frame) it requires a degree of contortion from the user when putting it down, which makes it difficult to close while holding a baby.

Thus if the carer is using one of the playpens currently on the market, she/he will either have to leave the baby in the playpen alone, if going to a different room, or place the baby on the floor, while dismantling, moving and erecting the playpen into another room. This obviously places the child at risk, there not likely to be a similar safe facility available in every room of a house/office, etc. Presently, playpens require several movements to construct/dismantle, which cannot be done while holding a baby.

There are pop up travel cots which are light to carry and easy to erect, but they cannot be collapsed while holding a baby and they do not have the stability to stay upright if a baby is moving inside and leans on the side.

SUMMARY OF INVENTION

The present invention sets out to facilitate the carer's task of moving and securing a baby into a few easy stages, with no need to put the baby down and to overcome one or more of the disadvantages mentioned above.

Accordingly there is provided a portable playpen which can be erected, collapsed and carried while holding a baby, comprising a framework supporting an enclosure for a child, the framework having a generally pyramidal structure when erected.

It will be understood that the generally pyramidal framework need not have straight sides, meet at the apex or have a particular number of sides such as three or four, although each of these are preferred features, it is the overall broadly pyramidal shape that is important to the playpen and is useful in making it easily foldable while carrying a baby and stable when erected.

Additional preferred features, including preferred apparatus for folding/unfolding the playpen are set out in the dependent claims.

The playpen may comprise four generally tubular sectioned legs formed in the general shape of a pyramid. The apex of the structure may consist of general joining mechanism to which each of the four or more elements of the structure are attached; the joining, preferably hinge, movement may be restricted to avoid over movement and to provide a more stable platform for the operating mechanism.

In one particularly preferred aspect the operating mechanism will consists of a sliding plunger or drive actuator that extends through a hinging platform. One end of the plunger's shaft is provided with a suitable operating handle, the other end is provided with four conveniently positioned hinge points spaced around the circumference of the end of the plunger shaft. Attached to the four hinge points are four equal length spring steel tie rods or gas struts, which are able to act as a resilient member useful in erecting the playpen and as a limiting mechanism to stop the legs from splaying too far apart. To operate the opening mechanism the operator takes hold of the playpen by the operating handle of the sliding plunger that is centrally mounted at the top of the folding mechanism ensuring good contact with the floor. By further pressing down on the handle the plunger is driven through the mechanism mounting plate, the action energizes the four spring tie rods, gas struts or the like that deform to store the energy. Near to the end of the plunger travel there may be a sprung cotter assembly which engages to prevent further movement.

The operator then lifts the handle so the playpen is disengaged from the standing surface, which may be a carpet, smooth floor or generally horizontal surface. The disengagement enables the four sprung tie rods to release the stored energy urging the legs radially, simultaneously stretching the folded pod to its operational form.

The sprung tie rods in their non-energized state provide the radially outward limiting factor to the four or more tubular elements, also bracing the playpen in its assembled state. In the folded mode the four or more elements of the pyramid are aligned generally under the apex of pyramid form in general proximity to the hinge mechanism.

To fold the playpen the operator disengages the latch arrangement by pressing a conveniently located spring loaded button located in the handle or knob, then lifts the playpen, and the elasticized pod then folds the pod drawing in the legs of the pyramid. As the tie rods are also suspending the weight of the lower portion of the playpen at a greater distance radially away from their pivot points they will tend to draw in the four vertical elements to their folded position.

In the closed position the latch mechanism is realigned with a second groove or detent point thereby securing the legs of the playpen in the transport position with the pod folded.

Further aspects and advantages of the invention may become clear from the following non-limiting description of certain preferred embodiments.

Figure 1:
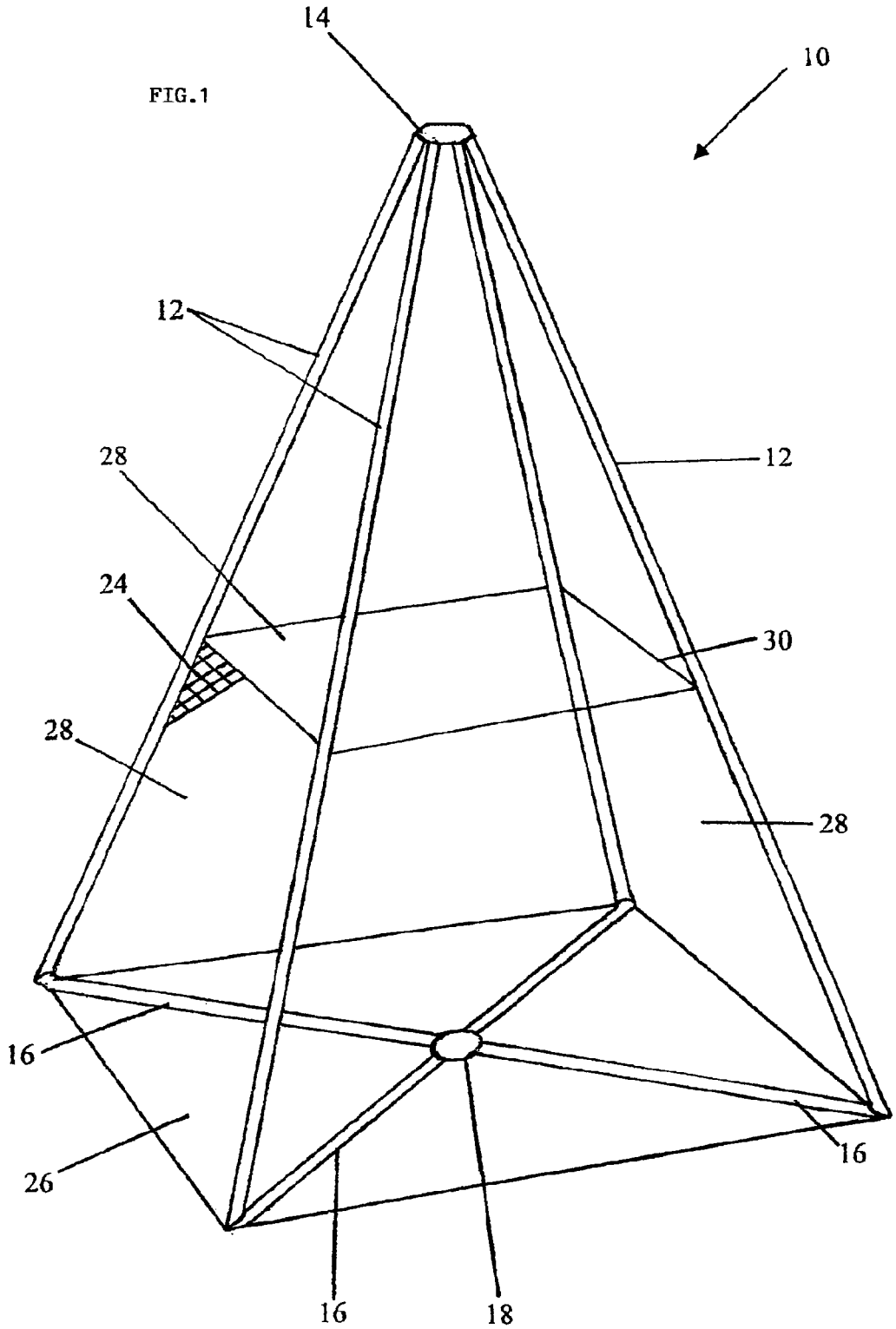
FIG. 1 shows a perspective view of a portable playpen according to a first embodiment of the invention.
Figure 2:
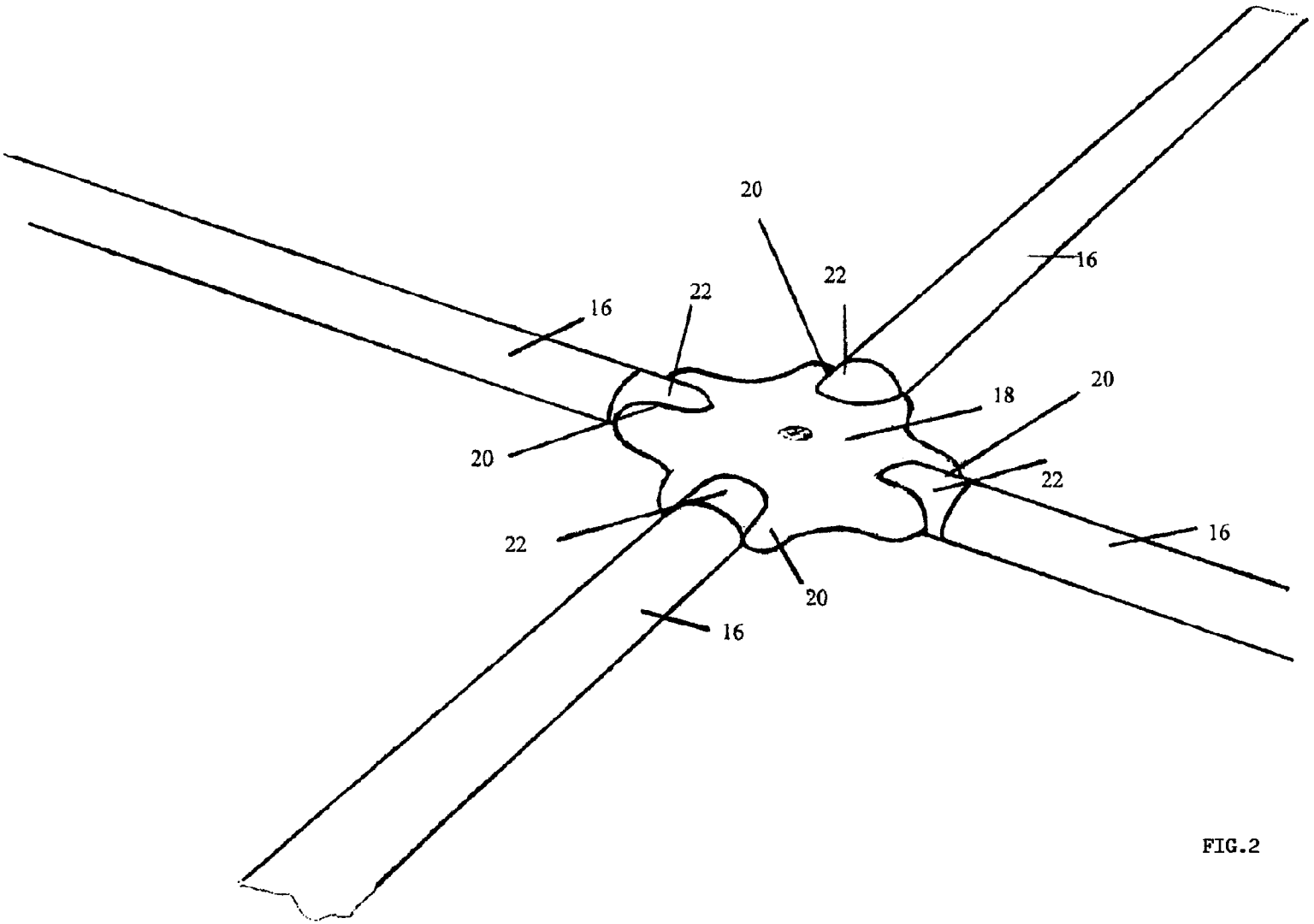
FIG. 2 shows an enlarged view of a portion of the base of the portable playpen according to the first embodiment.

Referring to FIGS. 1 and 2, a playpen 10 according to the first embodiment includes four legs, 12, which are suitably formed as circular section tubes or poles made for example of aluminium, another suitable metal or plastic. Bamboo, or another wood may also be suitable for the legs and would add an element of sustainability to the invention. The legs 12 are shown straight in the drawings, but could alternatively be made with a dogleg as described in later embodiments. The legs 12 are joined together at one of their ends by a joint 14 in which they can swivel. The end at which the four legs 12 are joined forms the apex of the erected playpen. The joint 14 may be similar to the type used to connect the legs of a tripod, moulded from plastic and having four joining portions into which the ends of each of the legs 12, are inserted. The ends of the legs 12 can be provided with a pair of retaining pins on each side which clip into corresponding holes in the joining portions so as to provide a pivot about which the legs can swivel.

At the opposite end of the legs 12 to the joint 14 at the apex, each leg 12 is rotatably connected to one of four links or struts 16 which make up the base of the generally pyramidal framework of the playpen. The struts 16 are equal in length and meet in the middle of the base, they too may be formed from aluminium tubes.

The joint 18 where the struts 16 meet is generally similar to the joint 14 at the apex of the structure and includes four joining portions 20 with coaxial holes (not shown). The struts may be provided with heads 22 which have pins (not shown) extending collinearly from each side which clip into the collinear holes in the joining portions 20 of the joint 18.

By lifting the joint 18 that links the struts towards the joint 14 at the apex, the legs 12 and struts 16 are brought closer to parallel with each other with the angle between each strut 16 and the leg 12 to which it is joined becomes smaller. This brings the playpen into its collapsed position, making it less cumbersome to carry. Of course, in the illustrated embodiment the legs will not be totally parallel, but if the joint at the apex was adjusted so that the legs 12 were held further apart from one another it would be possible for them to be completely parallel.

The joint 18 where the struts 16 meet differs from the one at the apex in that it is made heavier (the struts 16 could also/instead be weighted at their ends closest to the joint 18 where they meet). Because of this weighting, when the collapsed playpen 10 is placed with one or two legs 12 on the ground and the others raised, gravity acts on the weighted portion to draw it downward. This downward action causes the struts 16 to push the bottom of the legs 12 apart so that the framework adopts its generally pyramidal configuration.

An enclosure for a child, or "pod" 24 (shown cut away) is attached to the framework of the playpen 10. The pod 24 may be formed out of a suitable soft material, for example a fabric made of cotton and is capable of being attached to the vertical elements of the structure, for example by clipping on with poppers attached to the top edge of the pod 24 and half way up the legs 12. The pod 24 takes the same shape as the bottom half of the playpen 10 when erected; thus, in this embodiment it has a square base 26 and four isosceles trapezoid side panels 28 tapering towards the apex of the framework.

The pod or enclosure 24 is also attached to the lower end of the legs 12 near the feet of the playpen and should be easily detachable for replacement or cleaning. The pod 24 also includes an elastic portion, such as an elastic strip 30 weaved into or otherwise attached to each of the side panels 28 of the pod 24. The purpose of the elastication is to enable the pod 24 to be drawn up within the confines of the legs 12 of the pyramid structure when the playpen 10 is folded. The pod 24 may include fabric pleating to ease its folding.

As an alternative to weighting the struts 16 or the joint 18 the pod itself could be weighted in its base 26 to provide the downward motion that opens the framework erecting the playpen.

The weighted portion could be fastenable to the apex, to keep the playpen 10 in its collapsed state, for example by a cord which could be unclipped to allow the playpen to open. Such a cord could serve a secondary function such as holding a mobile to amuse a baby or child. There could also be provided a means to draw the base upwards, such as a sprung retractable cord attached to the joint 14 at the apex which may be engaged for lifting and folding.

The pod 24 may be attached outside or inside the framework, but if it is outside, or if the base 26 is attached to the struts 16 or joint 18 towards the middle, it will prevent the framework from adopting a position with the struts extending straight on beyond the bottom of the legs 12 i.e. a long thin position. This may also be prevented by providing stops in the joint 18 at the middle of the struts 16 or where the struts 16 meet the legs 12.

Of course, it is not absolutely necessary for the struts 16 to be placed at the bottom of the legs 12. They could be placed higher up the structure, perhaps just a third of the way down the legs 12, so that they are out of the reach of the baby and do not obstruct the process of placing it in the enclosure 24. In this case, as opposed to when the struts are at or near the base, it would be more important that stops are provided, or a permanent connection is provided between the weighted joint 18 and the joint 14 at the apex to prevent the weighted portion from drawing the legs back together from the generally pyramidal position to a folded position.

Figure 3:
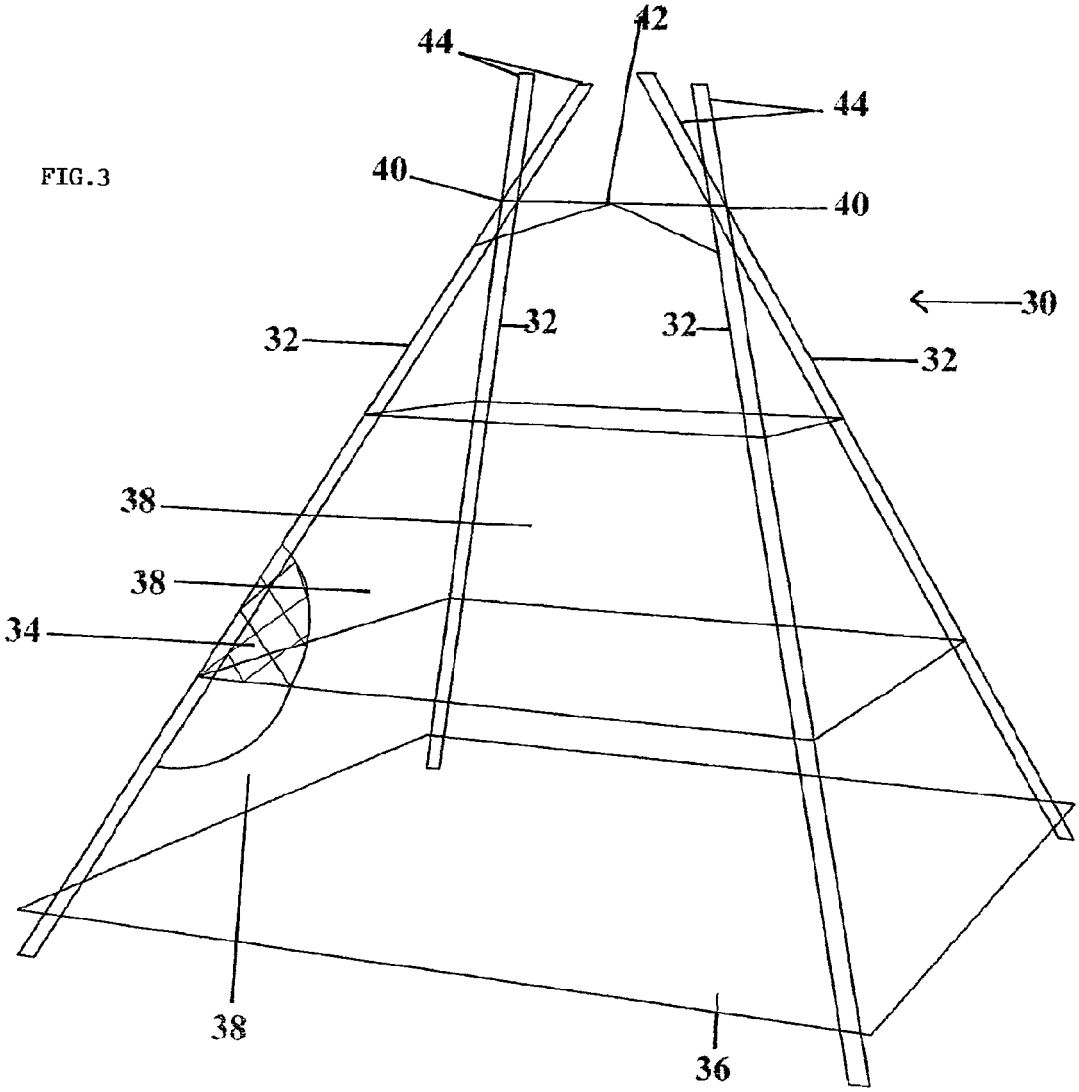
FIG. 3 shows a perspective view of a second embodiment of the invention.

Referring to FIG. 3, a second embodiment of the invention is shown which has certain parts which are the same or similar to those of the first embodiment. In particular the playpen 30 includes four legs 32 arranged so as to form a generally pyramidal framework, and a pod 34 formed from a rectangular base 36 and four isosceles trapezoidal side panels 38. The major difference between the second and first embodiments is the lack of the struts 16 and weighted portion.

Instead, to erect the playpen 30 of the second embodiment a scissor arrangement is used to draw the legs 32 apart and put them together. Accordingly, the legs 32 are arranged as two pairs, each leg 32 of each pair connected to the other leg 32 of the pair by a hinge 40, which may be provided for example as a pin formed by a rivet driven through the pair of legs 32. The hinge 40 is provided at a suitable point in the legs 32 such that enough of each leg 32 extends beyond the hinge 40 so that it can be used as a handle 44 to lever the legs 32 apart. The two pairs of legs are connected to each other by a folding link 42.

To open the playpen, it is arranged with one leg from each pair on the floor and the end of the operator grasps the handles of the legs that are not on the ground and applies force downwards and towards the user, so as to effect the scissor motion driving the feet of the legs 32 away from each other. In order to assist the movement of the vertical elements a means to lessen contact friction with the floor is provided, this may be in the form of skids or rollers (not shown). Preferably one leg of each pair is provided with a high friction (e.g. rubber) foot and the other is provided with the skid or roller, in this way the legs placed on the floor, with the high friction feet will stay in place and the other legs may easily be spread away from them, even if they are not lifted into the air.

Once the two pairs of legs 32 are in their open positions they can be spread away from each other by drawing the tops of each pair towards each other, or the feet away from each other, so that the generally pyramidal structure shown in FIG. 3 is adopted. The playpen 30 is collapsed by reversing this procedure.

Figure 4:
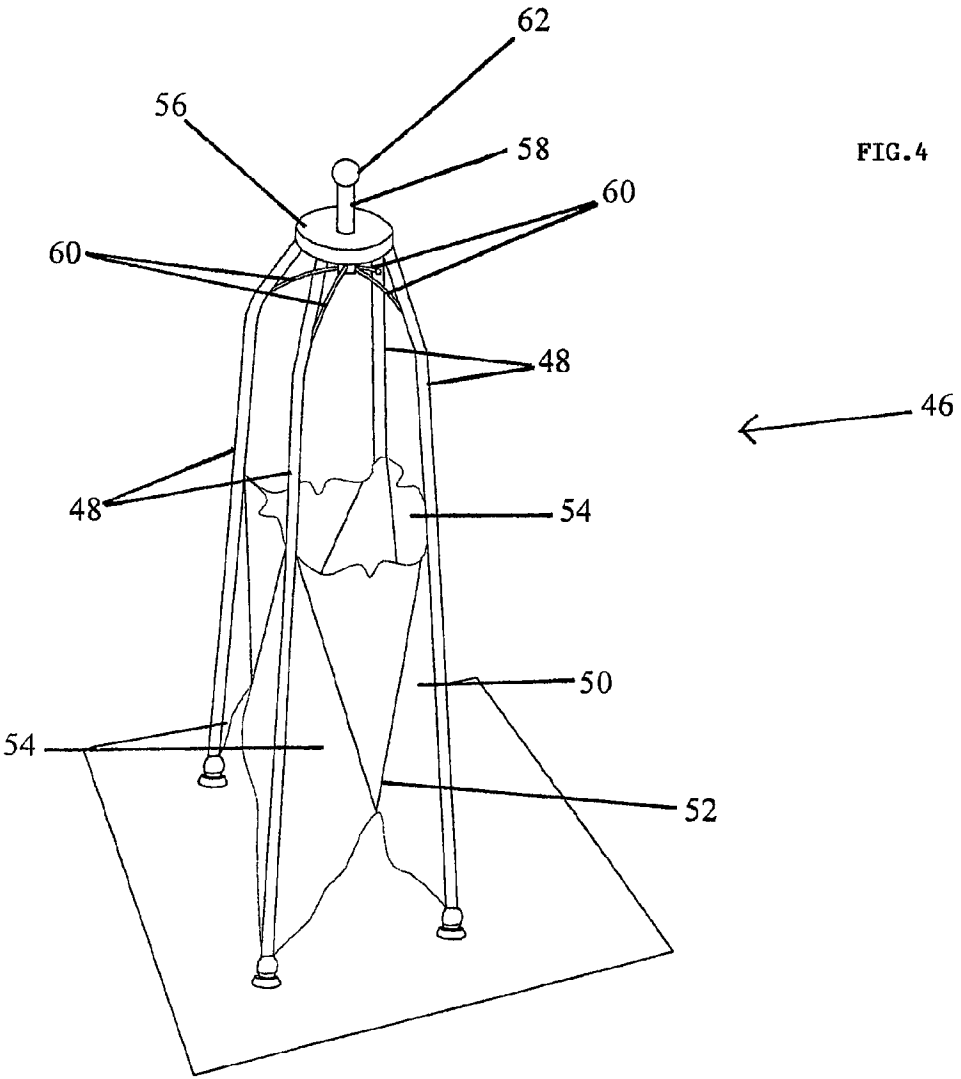
FIG. 4 shows a perspective view of a third embodiment of the invention in the collapsed state.

FIG. 4 illustrates the portable playpen 46 of the third embodiment, which also comprises four tubular legs 48 and an enclosure for a child 50. In this case the legs 48 are formed with a slight dogleg, so that in the folded position they are broadly parallel. Moreover, the enclosure 50 in the third embodiment is slightly different in that the elasticized strips 52 are attached at a mid point on the horizontal lower edge of each of the side panels 54 there being two or more strips 52 converging at this point, the strips 52 are sewn or attached by other suitable manufacturing means, generally tracking diagonally from the mid base of each panel 54 towards the outer top attachment corner of each of the four panels 54. Upon opening or assembling the playpen 46 the lower ends of the four legs 48 of the playpen 46 generally splay outwards from the apex simultaneously stretching the elasticized base of the pod 50.

The connection of the legs 48, at the apex of the generally pyramidal framework is via a control head 56 shown in more detail in FIGS. 7-10. The connection may be considered to be umbrella like, in that it includes a sliding element, or plunger 58 which is operable to erect/collapse the playpen as the axial motion is translated into radial motion by the connection with tie rods 60 which in this embodiment are sprung and are arranged one per leg, to assist in the opening and closing of the playpen. An actuation handle or knob 62 is provided at the top of the sliding element 58.

Figure 5:
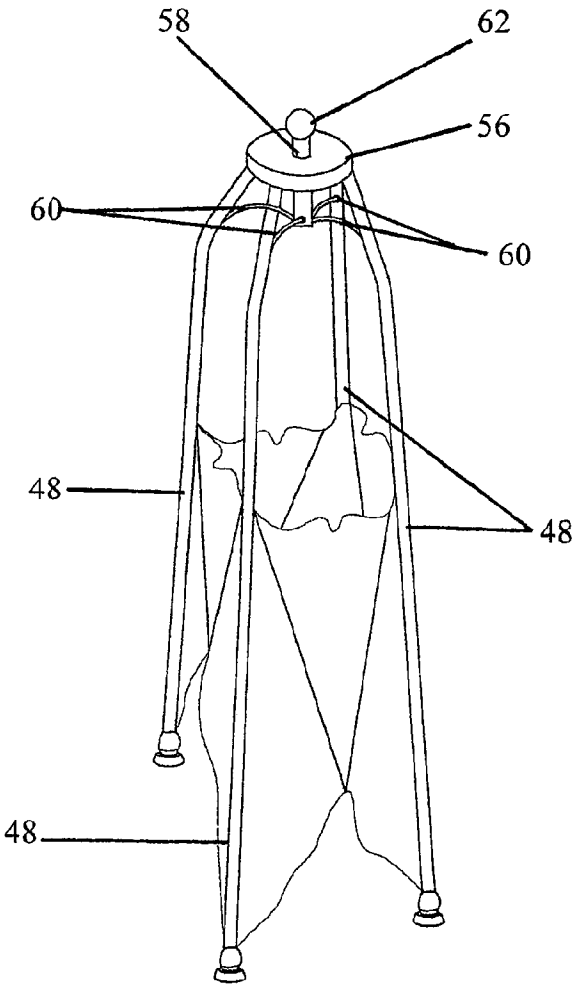
FIG. 5 shows a perspective view of a third embodiment of the invention in the collapsed state.
Figure 8:
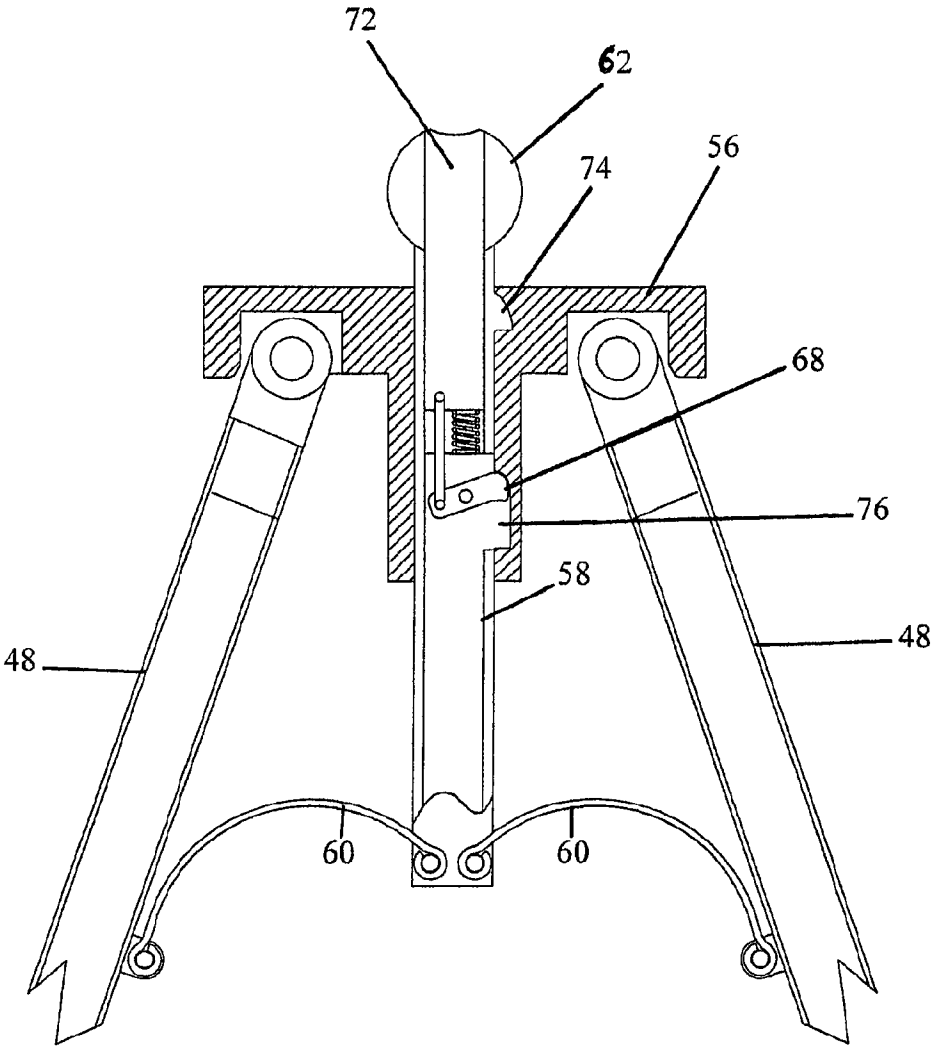

FIGS. 5 and 8 show the actuation handle 62 depressed such that the sliding element 58 extends through the body of the control head 56 and compresses the sprung tie rods 60 to store energy. The force applied by the operator on handle 62 is also transmitted to the standing surface so securing the legs 48 during the pre-assembly action. Once the handle is released, the stored energy generally forces the legs 48 apart. Gas springs (not shown) may be substituted for spring tie rods.

Figure 6:
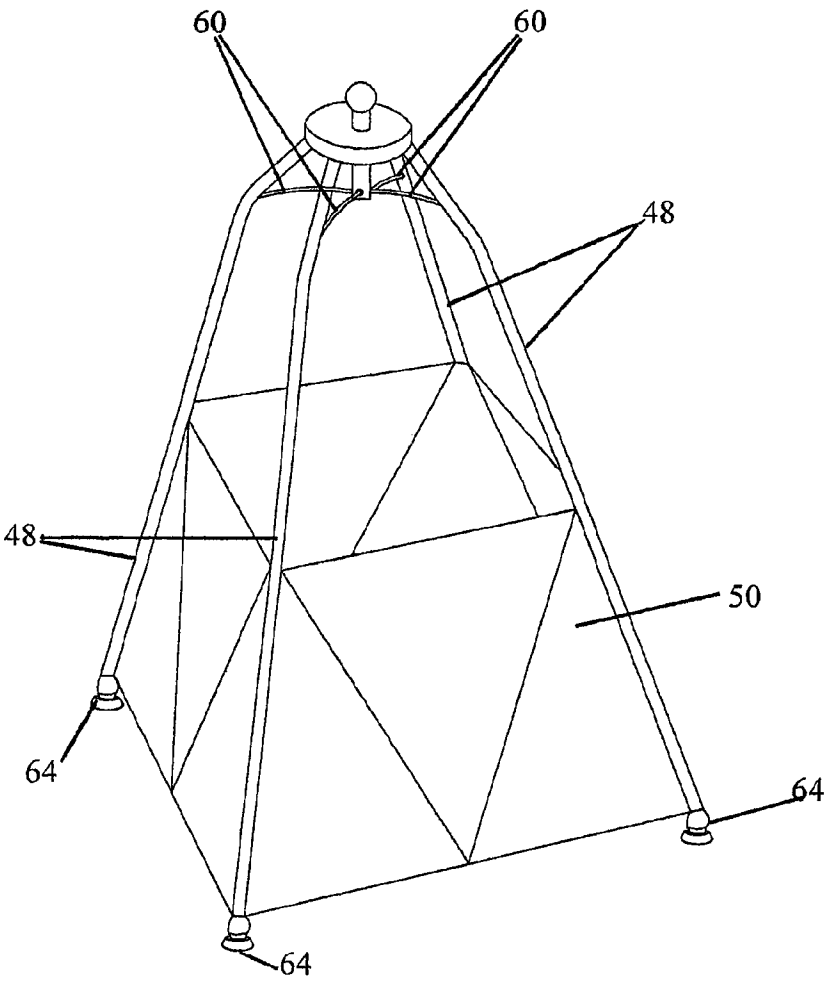
FIG. 6 shows a perspective view of a third embodiment of the invention in the erect state.
Figure 9:
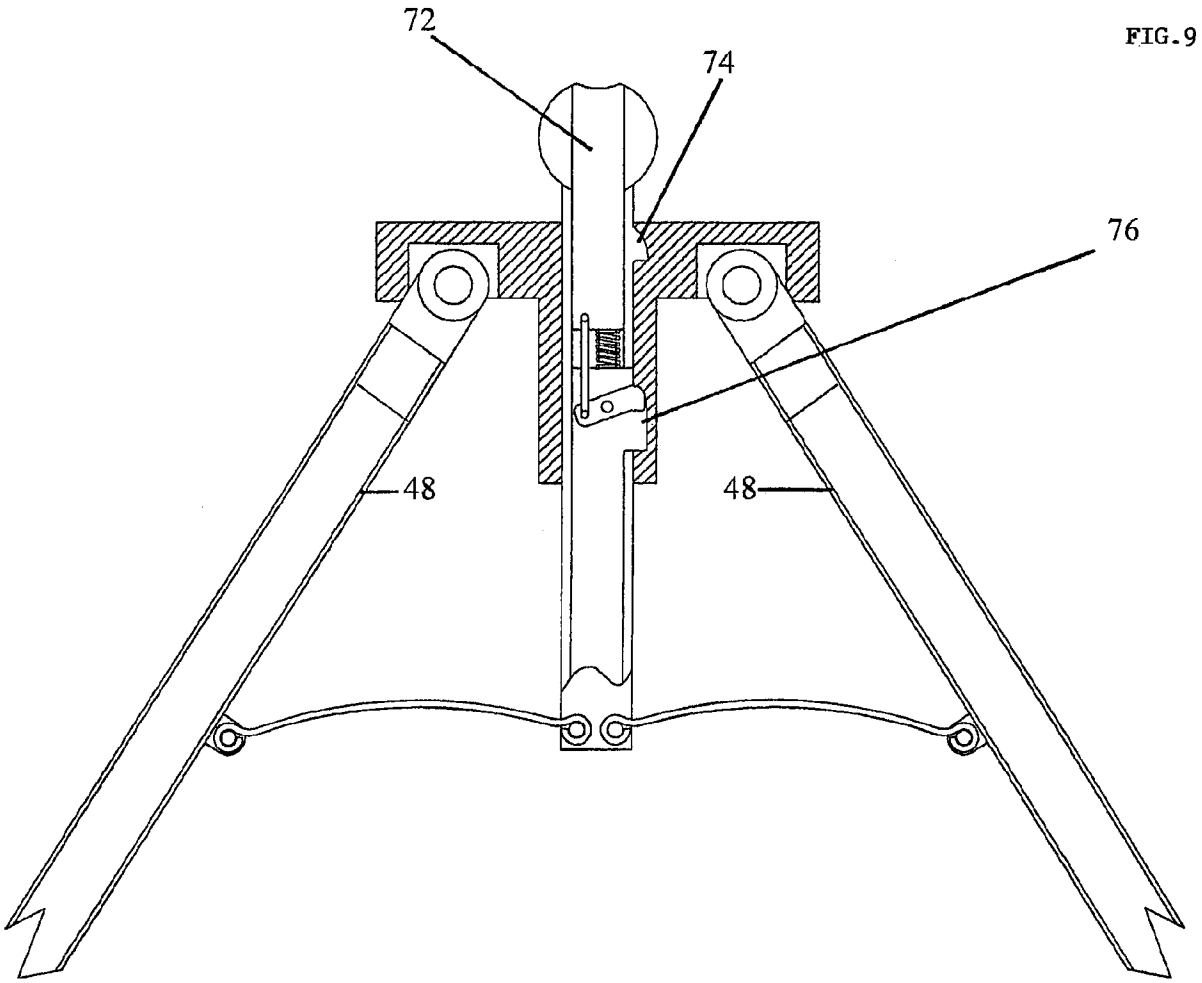

FIGS. 6 and 9 illustrate the playpen on its erect or open position, the operator having lifted the control head 56 upward. This action lifts the feet 64 which enables the energy stored in the tie rods 60 to act on the legs 48 driving them radially outwards. The material of the pod 50 is simultaneously stretched between the legs 48 thereby opening providing the enclosure.

To refold the playpen the operator lifts the handle 62 which triggers the collapse of the playpen 46 ready to move to the next station.

Figure 7:
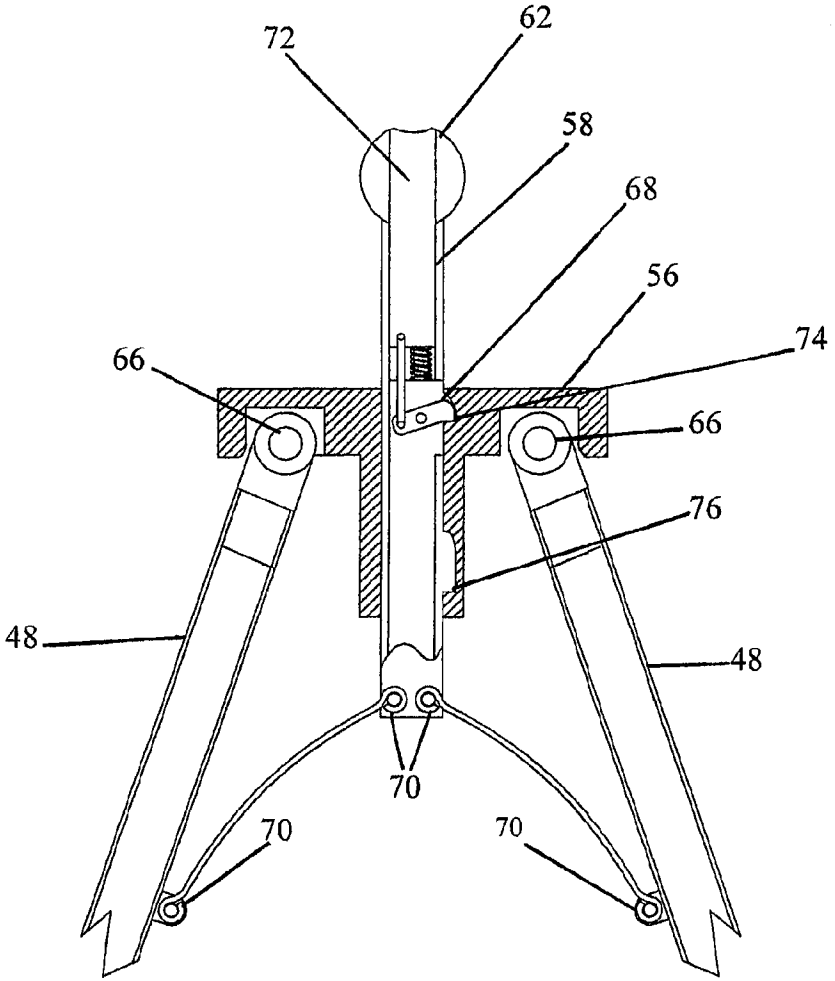
FIGS. 7-10 show cross sectional enlarged views of the operating mechanism of the third embodiment of the invention in different states.

FIG. 7 illustrates the main folding mechanism in greater detail, in cross section showing two, of the four legs 48 which are attached via swivel joints 66 to the control head 56 located at the apex of the playpen 46. The folding mechanism consists of drive actuator or sliding element 58, handle or knob 62, release mechanism 72, sprung latch mechanism 68, and spring tie rods 60 connected to both drive actuator 58 and legs 48 via corresponding rotating joints 70. Two fixed locking positions are provided by two catches 74 and 76; a lock position with the playpen 46 collapsed when the latch mechanism 68 is engaged with the first (upper) catch 74 as shown in FIG. 7, and a lock position with the playpen 46 erected, in which case the latch mechanism 68 is engaged with the second (lower) catch as shown in FIG. 9. The release mechanism 72 which is operable to unclip the sprung latch mechanism 68 is conveniently positioned in knob handle 62 extending axially through the sliding element 58.

FIG. 8 illustrates the arrangement once mechanical movement provided to energize the spring tie rods 60, by applying downward pressure to handle knob 62 pushing the sliding element 58 through the control head 56 the sprung tie rods are compressed due to the closer proximity of the rotating joints 70 on the sliding element 58 and those on the legs 48. In this position, the sprung latch mechanism 68 engages the second catch 76 causing the sliding element to remain in position with the tie rods compressed.

When the operator lifts the handle 62 so that at least two of the feet 46 of the playpen 46 are lifted off of the standing surface, or at least the friction between the feet and the floor is reduced, stored energy in sprung tie rods 60 is released and the legs 48 are pushed radially apart. The result of this action is shown in FIG. 9 and FIG. 6, in which it can be seen that the angle between the legs is increased and the playpen 46 adopts the erect, generally pyramidal structure.

Figure 10:
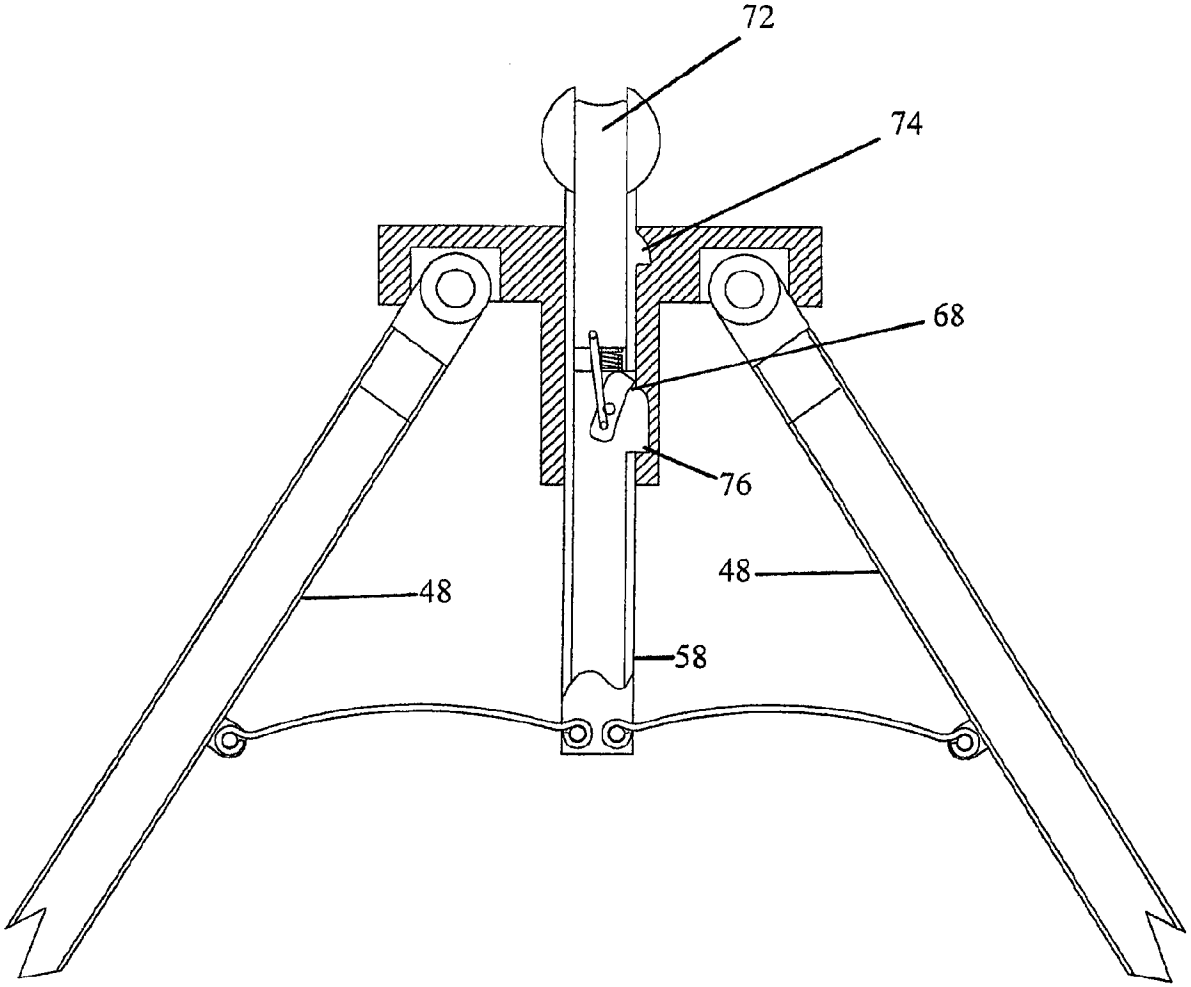

When it is desired to collapse the playpen 46, the operator depresses the release mechanism 72, as shown in FIG. 10, which unclips the sprung latch mechanism 68 from the catch 76 allowing the sliding element 58 to move axially upward. The legs 48 can then be pushed back together, for example by leaning the playpen 46 towards the user and secured in the collapsed state. Once the playpen 46 is collapsed, the latch mechanism engages eh first catch 74 securing it the collapsed state.

Figure 11:
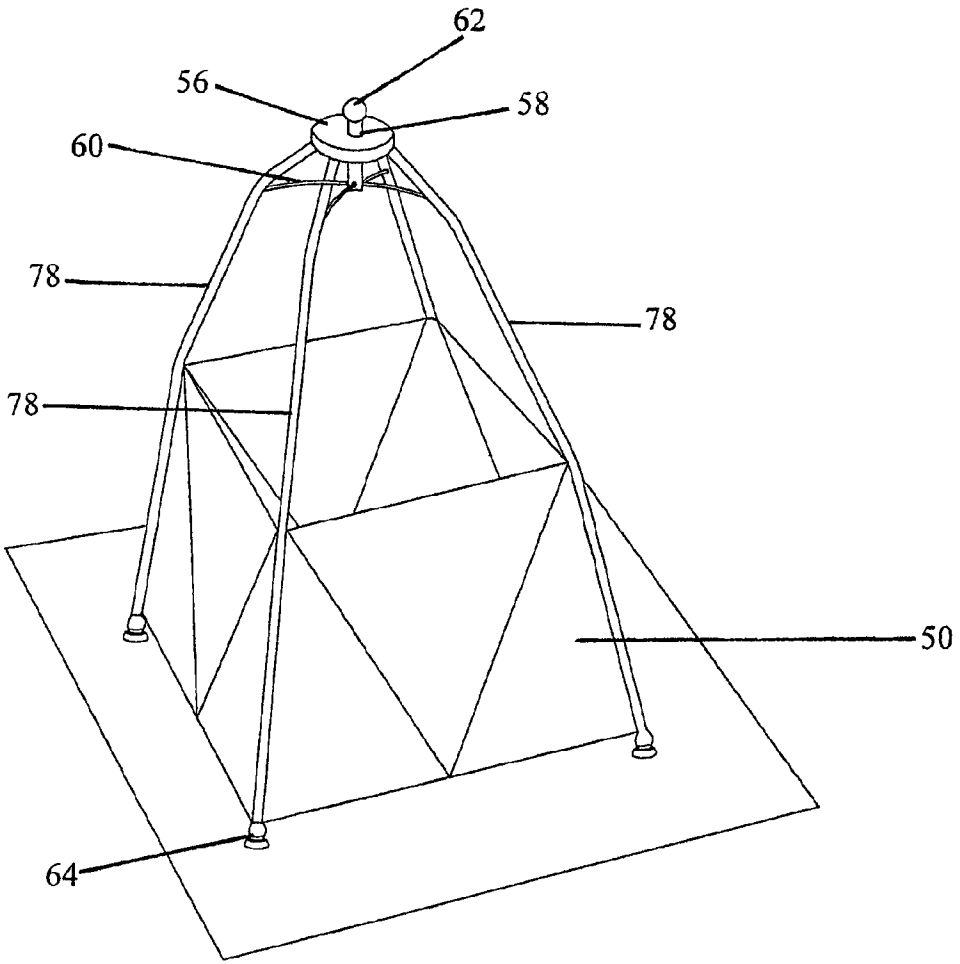
FIG. 11 shows a perspective view of a fourth embodiment of the invention.

FIG. 11 illustrates an alternative arrangement having identical features to those of the third embodiment hence the use of like reference numerals. The only difference is that the legs 78 in this fourth embodiment include a second dogleg bend in order to increase the receiving area of the pod or enclosure 50 for a child.

Of course, although there are four legs in each of the embodiments it may be convenient to construct the structure with a greater or lesser amount of legs and the term "generally pyramidal" should not be considered to limit to any particular number of legs/sides. Indeed even the provision of a circular base and a large number of legs should not be considered to fall outside the scope of "generally pyramidal", provided the overall impression is that the framework can be considered broadly to be pyramid shaped.

Another possibility within the ambit of the invention would be for the legs to be telescopic so that once the playpen is in the collapsed state, it can be made even smaller to aid carrying or reduce space taken up for storage or stowage in a car for example.

The invention claimed is:

1. A portable playpen which can be erected, collapsed and carried while holding a baby, comprising:

a framework supporting an enclosure for a child, the framework having a generally pyramidal structure when erected, and wherein the structure is adapted to be collapsed by a single hand of a user;

a plurality of legs comprising the framework and connected together at or near the apex of the generally pyramidal structure;

a plurality of struts being associated with one of each of the plurality of legs and being rotatably connected thereto;

a joint joining the plurality of struts and together making up the base of the generally pyramidal framework of the playpen; whereby the joint can be lifted toward the apex, so as to bring the legs and struts closer to parallel with each other and thereby bringing the playpen into its collapsed position.

2. A portable playpen according to claim 1 wherein the framework comprises four legs forming a pentahedron.

3. A portable playpen according to claim 1 further comprising a weighted portion attached to at least two of the plurality of legs in order to urge the legs apart and thereby erect the generally pyramidal framework.

4. A portable playpen according to claim 3 further comprising stops adapted to interact with links between the plurality of the legs and the weighted portion and thereby prevent the weighted portion from urging the plurality of legs back together.

5. A portable playpen according to claim 3 wherein the weighted portion is attached to the plurality of legs at or near their base, via the plurality of struts.

6. A portable playpen according to claim 1 wherein the plurality of legs are generally straight.

7. A portable playpen according to claim 1 wherein the plurality of legs include a dogleg.

8. A portable playpen according to claim 1 wherein the plurality of legs are made from wood.

9. A portable playpen according to claim 1 wherein the plurality of legs are made from bamboo.

10. A portable playpen according to claim 1 wherein each of the plurality of struts extends inwardly toward a center of the framework and meet at the joint.

* * * * *